US007214140B2

(12) United States Patent
Coombs

(10) Patent No.: US 7,214,140 B2
(45) Date of Patent: May 8, 2007

(54) GOLFER TRAINING AID

(76) Inventor: John Michael Coombs, 2435 Scenic Dr., Salt Lake City, UT (US) 84109

( * ) Notice: Subject to any disclaimer, the term of this patent is extended or adjusted under 35 U.S.C. 154(b) by 123 days.

(21) Appl. No.: 11/198,608

(22) Filed: Aug. 5, 2005

(65) Prior Publication Data

US 2007/0032307 A1 Feb. 8, 2007

(51) Int. Cl.
*A63B 69/36* (2006.01)

(52) U.S. Cl. ..... 473/278; 473/257; 473/265

(58) Field of Classification Search ..... 473/278, 473/257, 218, 265, 266, 270
See application file for complete search history.

(56) References Cited

U.S. PATENT DOCUMENTS

| | | | | |
|---|---|---|---|---|
| 1,637,339 | A | 8/1927 | Glennon et al. | |
| 2,801,857 | A * | 8/1957 | Strunk | 473/265 |
| 3,018,109 | A * | 1/1962 | Starck | 473/265 |
| 3,194,565 | A | 7/1965 | Schroer | |
| 3,561,764 | A * | 2/1971 | Thomas | 473/257 |
| 3,741,550 | A * | 6/1973 | Landures | 473/265 |
| 3,992,013 | A | 11/1976 | Golden | |
| 4,355,810 | A | 10/1982 | Rydeck | |
| 4,465,281 | A * | 8/1984 | Whitfield | 473/265 |
| 4,826,174 | A * | 5/1989 | Hoyt, Jr. | 473/157 |
| 4,913,440 | A * | 4/1990 | Ellington | 473/265 |
| 4,930,786 | A * | 6/1990 | Bencriscutto | 473/265 |
| 5,004,243 | A * | 4/1991 | Dlouhy | 473/279 |
| 5,350,177 | A | 9/1994 | Furbush, Jr. | |
| D358,440 | S | 5/1995 | Clayton et al. | |
| 5,443,265 | A * | 8/1995 | Wheeler | 473/257 |
| D407,773 | S * | 4/1999 | Greig | D21/791 |
| 6,561,920 | B1 | 5/2003 | Hamilton | |
| 6,821,210 | B2 | 11/2004 | Kallage, Jr. | |
| 2004/0185954 | A1 * | 9/2004 | Kallage, Jr. | 473/218 |
| 2005/0227774 | A1 * | 10/2005 | Buck | 473/218 |

* cited by examiner

*Primary Examiner*—Raleigh W. Chiu
(74) *Attorney, Agent, or Firm*—Joseph W. Holland

(57) ABSTRACT

A golfer training aid formed, preferably, of a synthetic turf. A first swing channel is defined by an area between opposing uprights projecting from an upper surface of the mat. A second swing channel is defined by a cut-away portion of the mat. The first swing path permits a golfer to practice a swing on the mat. The second swing path permits a golfer to practice a swing on any of a variety of surfaces including natural, manufactured or constructed which are exposed through the cut-away portion. The second swing path may also be defined by opposing rows of uprights. A golfer is aided in visualizing and executing a proper golf swing by the visual and physical cues afforded by the first and second swing channels of the golfer training aid.

19 Claims, 6 Drawing Sheets

GOLFER TRAINING AID

BACKGROUND OF THE INVENTION

1. Technical Field

The present invention relates generally to a golf training aid and more particularly, the present invention relates to a golfer training aid for use in teaching a golfer proper swing form resulting in golf shots having a substantially straight trajectory.

2. Background

The prior art relating to golf teaching aids includes a variety of devices and assemblies directed towards assisting and training a golfer in learning proper swing form and mechanics. The prior art includes U.S. Pat. No. 6,821,210 to Kallage, Jr., entitled Golf Aiming and Alignment Training Mat, discloses an L-shaped golf training mat. The mat includes positioning-aiming markings, which are aligned on the upper mat surface for enabling the golfer to visualize an effective ball-placement-zone removed from the L-shaped mat. The mat provides an auxiliary alignment blade removably attachable to the mat for enabling the golfer to align and aim golf shots for variably controlled golf ball flight trajectories. The blade includes reference markings which function in cooperative association with positioning-aiming markings on the superior mat surface for enabling a golfer to align and aim for variably controlled golf ball flight trajectories.

U.S. Pat. No. 6,561,920 to Hamilton, entitled Golf Stroke Training Device and Method, discloses a golf-putting guide that is placed on the ground between a golfer and a golf ball. It has a vertical front surface facing the ball that is part of the elliptical vertical projection of a desired swing circle of the club head. The heel of the club head slides along the front surface of the guide in putting practice, guiding the club head in a planar swing circle that is centered between the golfer's shoulders. The top surface of the guide is marked with a series of clubface alignment lines extending backward from the top front edge of the guide. Each of the lines is perpendicular to a line tangent to the elliptical top front edge of the guide. These lines visually guide the alignment of the club head as it moves along the front surface of the guide so the club rotates only on a single axis.

U.S. Pat. No. 5,350,177 to Furbush, Jr., entitled Golf Club Swing Training Apparatus, discloses a device that provides for several aspects of training in the game of golf. The trainer includes a pair of guides that may be aligned with the intended ball trajectory and guide connecting links adjusted to provide visual alignment cues to the desired trajectory. Adjustable positioning markers are adjusted to provide assistance in the placement of the ball, the golfer's left and right foot, and the club swing arc, thus defining the proper placement and positioning for the club swing arc to properly strike the ball to drive it along a desired trajectory. A fence extends upward from each guide, so the swing trainer will be displaced if the club head is too far either side of the desired arc.

U.S. Pat. No. 4,355,810 to Rydeck, entitled Golf Club Swing Training Device, discloses a golf swing training apparatus having a plastic grass mat that shows the proper positions for the feet and hips for a golf swing, wherein the body and the golf club have to be coordinated. It gives the golfer the positions for putting, chipping, pitching, iron shots, and wood shots. A plastic or rubber guideway for the golf club is built into the mat and it shows the golfer how to position and also how to rotate his shoulders properly. The guideway shows visually, mentally, and physically how to swing the club properly, that is straight back and then to the inside, on the backswing. On the downswing it comes down inside, then straight through at the ball area, then back inside. There is a tension spring in the guideway that squares the golf club face to the target and makes the ball go straight. The back end of the guideway is flared out so that incorrect swings are corrected while the golfer is learning. There is also a tension device that is used for pitch shots, iron shots, and wood shots that trains the golfer into the correct foot and leg action. It also shows him how to resist or hold back with his upper body while his lower body starts the downswing.

U.S. Pat. No. 3,992,013 to Golden, entitled Golf Club Swing Training Method, discloses a method and device for recording the swing of a golf club over a mat and permitting the analysis of the depth of the swing, the arc of the swing and the angle of the face of the golf club head when it contacts the mat. A resilient mat is covered with a thin film of chalk dust and a golf club having an attachment secured to the golf club head capable of dispersing the dust on the mat when it contacts the mat. The dust is dispersed in a pattern on the mat, which due to the attachment, permits analysis to determine the foregoing. The mat may also be provided with indicia related to a golf ball and the equivalence of making a divot by the golfer may also be determined.

U.S. Pat. No. 3,194,565 to Schroer, entitled Indicator Device Actuable by the Movement of a Golf Club Head Between Two Spaced Strips on a Mat, discloses a golf swing practice device that includes a mat including a pair of upstanding elongated strips through which the golfer is to pass the club head on the swing.

U.S. Pat. No. 1,637,339 to Glennon et al, entitled Means for Instructing Golf Strokes discloses a device for the instruction of golf strokes, which comprises a base member and a pair of laterally spaced longitudinally extending upstanding guide shoulders on the base member. The paired guide members are adapted to define a guide way for the free passage of the head of a properly swung golf club. A golf ball is placed between the guide members on the base member and may be addressed by the head of a properly swung golf club between the guide members.

U.S. Pat. D407,773 to Greig, entitled Golfclub Swing-Path and Face-Angle Training-Mat, discloses an ornamental design for a golf club swing-path and face-angle training-mat, that includes front and rear rows of upward extending brushes that define a club head swing path.

U.S. Pat. D358,440 to Clayton, et al., entitled Golf Training Mat, discloses an ornamental design for a golf club swing-path and face-angle training-mat, that provides a stance silhouette and a series of club head silhouettes which are intended to provide a proper relationship between stance, club head position, golf club swing-path and face-angle.

While the prior art provides any of a number of devices aimed at assisting and training a golfer in learning proper swing form and mechanics, it appears that none of the previously disclosed devices provide opposing swing alignment elements for both on and off mat practice. Additionally, it appears that none of the previously disclosed devices provide both opposing swing alignment elements and a ball teeing capability. Additionally, it appears that none of the previously disclosed devices provide both opposing swing alignment elements and a removable ball teeing capability.

Therefore, advantage may be found in providing a device aimed at assisting and training a golfer in learning proper swing form and mechanics that provides opposing swing alignment elements for both on and off mat practice. Additionally, advantage may be found in providing a device aimed at assisting and training a golfer in learning proper swing form and mechanics that provides both opposing swing alignment elements and a ball teeing capability. Additionally, it advantage may be found in providing a device aimed at assisting and training a golfer in learning proper swing form and mechanics that provides both opposing swing alignment elements and a removable ball teeing capability. Advantage may also be found in providing a device aimed at assisting and training a golfer in practicing proper swing form and mechanics, resulting in golf shots having a substantially straight trajectory, by practicing the golf swing between swing channels provided both on a synthetic surface and on or above a natural terrain.

Therefore, an objective of the present invention is to provide a device aimed at assisting and training a golfer in learning proper swing form and mechanics that provides opposing swing alignment elements for both on and off mat practice. Another objective of the present invention is to provide a device aimed at assisting and training a golfer in learning proper swing form and mechanics that provides both opposing swing alignment elements and a ball teeing capability. An additional objective of the present invention is to provide a device aimed at assisting and training a golfer in learning proper swing form and mechanics that provides both opposing swing alignment elements and a removable ball teeing capability.

SUMMARY OF THE INVENTION

The present invention is directed to a golfer training aid including a mat having a generally planar upper surface. A first swing channel is defined by an area of the mat located between first and second opposing uprights. In the preferred embodiment, the first and second opposing uprights project from the upper surface of the mat. A second swing channel is defined by opposing edges of a cut-away portion of the mat. The second swing path permits a golfer to practice a swing on any of a variety of surfaces including natural, manufactured or constructed, which are exposed through the cut-away portion of the mat. The second swing path may also be defined by an area of the generally planar upper surface located between opposing rows of uprights which project from the upper surface of the mat. A golfer is aided in visualizing and executing a proper golf swing by the visual and physical cues afforded by the first and second swing channels of the golfer training aid.

In the preferred embodiment, the generally planar surface is formed of a synthetic turf. Also in the preferred embodiment, each of the first, second and third rows of uprights are configured as flexible, resilient impact resistant, tubular elements. In the preferred embodiment, the opposing rows of uprights are configured as rubber tees.

Additional advantages and novel features of the invention will be set forth in part in the description that follows, and in part will become apparent to those skilled in the art upon examination of the following, or may be learned by practice of the invention. Additionally, the advantages of the invention may be realized and attained by means of the instrumentalities and combinations particularly pointed out in the appended claims.

DETAILED DESCRIPTION OF THE INVENTION

Referring to FIGS. 1 through 7, a first preferred embodiment of golfer training aid 10 is shown to advantage in the views described above.

Referring to FIGS. 8 through 14, an alternate preferred embodiment of golfer training aid 100 is shown to advantage in the views described above.

Figure 1:
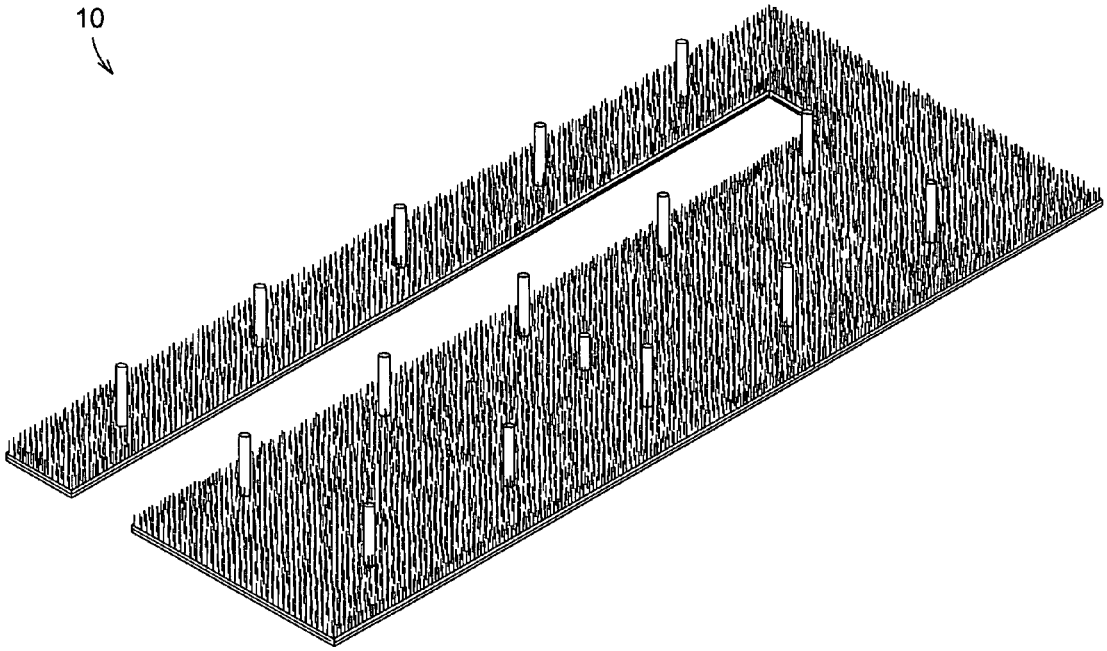
FIG. 1 is a representative perspective view of a golfer training aid according to the present invention.
Figure 2:
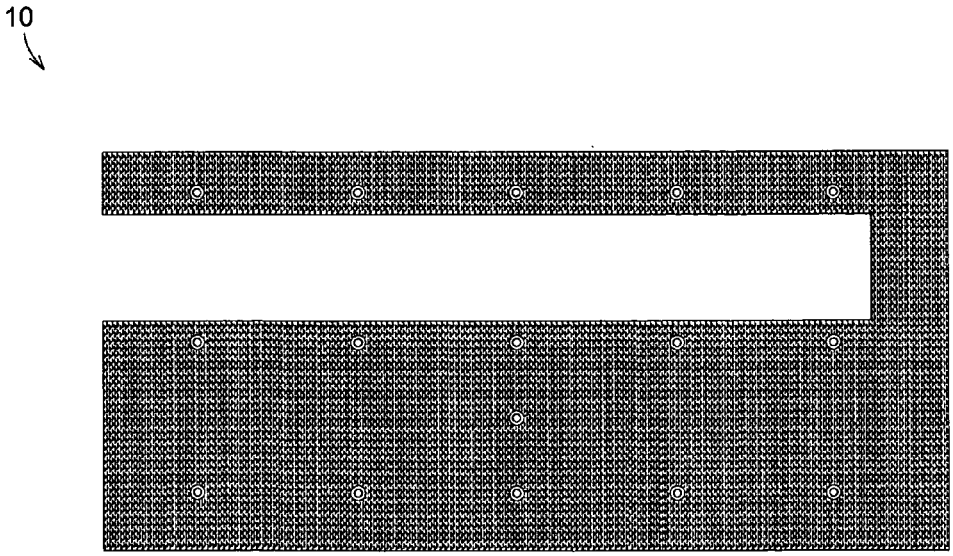
FIG. 2 is a representative top view of a golfer training aid according to the present invention.
Figure 3:
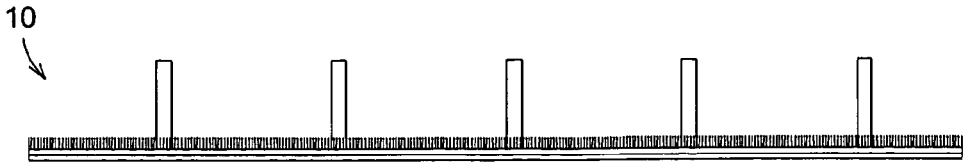
FIG. 3 is a representative first side view of a golfer training aid according to the present invention.
Figure 4:
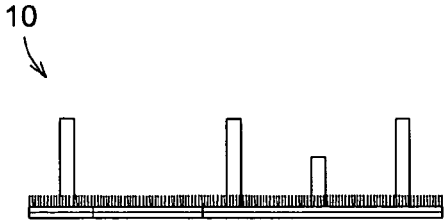
FIG. 4 is a representative first end view of a golfer training aid according to the present invention.
Figure 5:
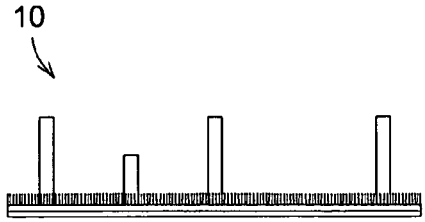
FIG. 5 is a representative second side view of a golfer training aid according to the present invention.
Figure 6:
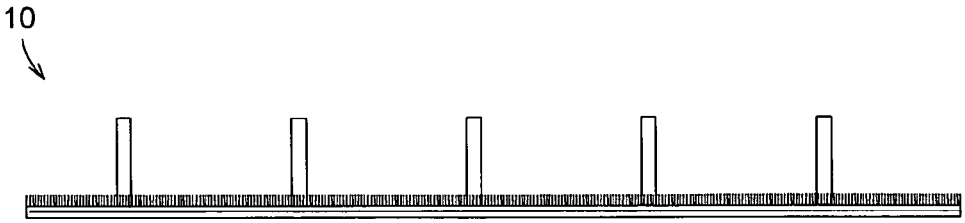
FIG. 6 is a representative first end view of a golfer training aid according to the present invention.
Figure 7:
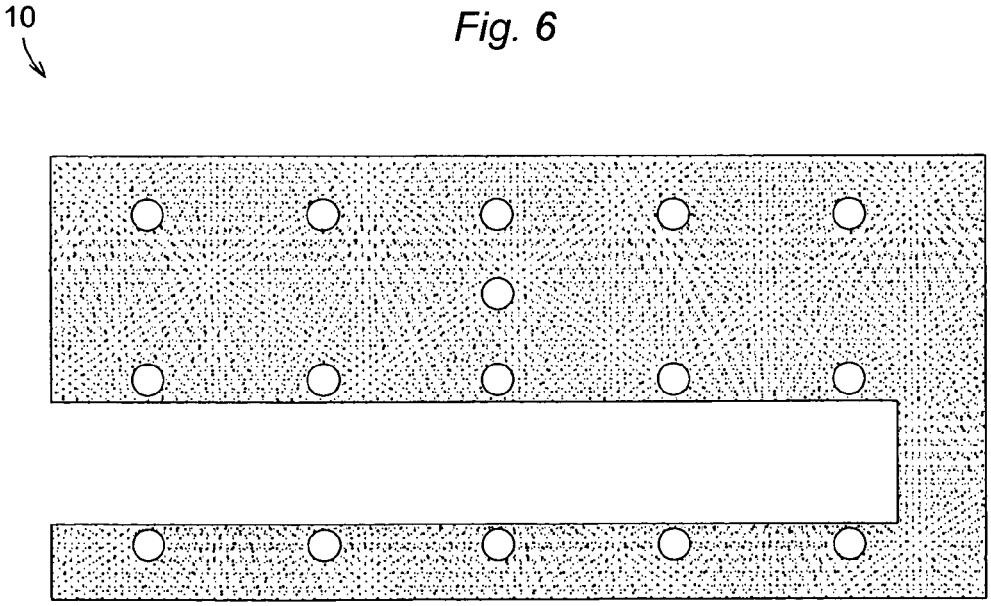
FIG. 7 is a representative bottom view of a golfer training aid according to the present invention.
Figure 8:
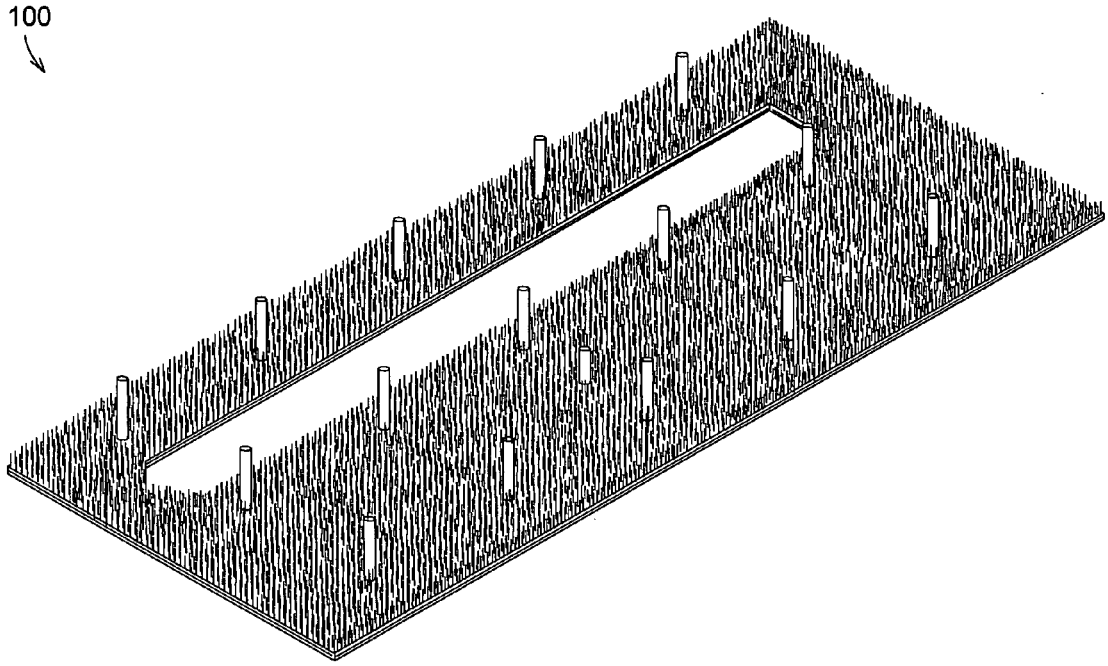
FIG. 8 is a representative perspective view of a golfer training aid according to the present invention.
Figure 9:
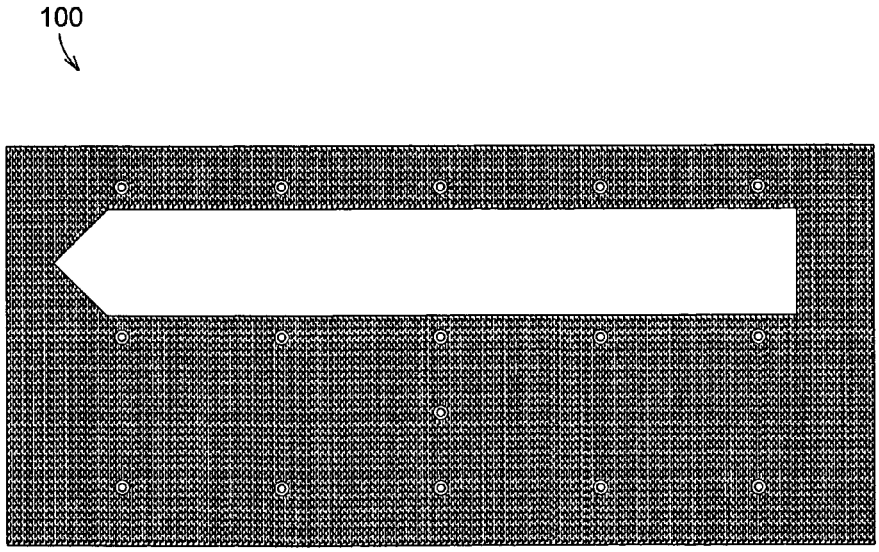
FIG. 9 is a representative top view of a golfer training aid according to the present invention.
Figure 10:
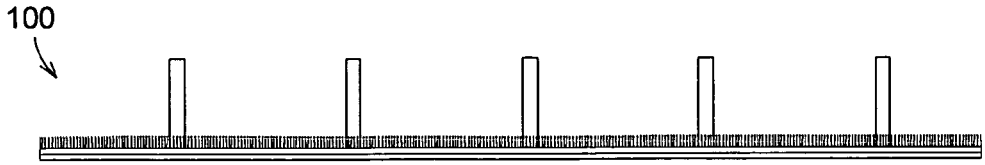
FIG. 10 is a representative first side view of a golfer training aid according to the present invention.
Figure 11:
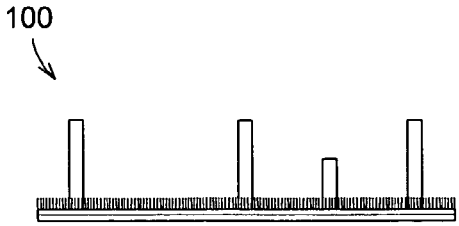
FIG. 11 is a representative first end view of a golfer training aid according to the present invention.
Figure 12:
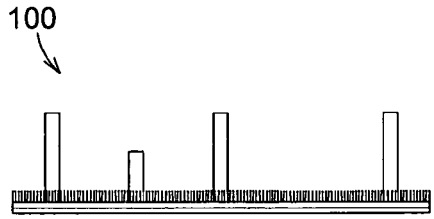
FIG. 12 is a representative second side view of a golfer training aid according to the present invention.
Figure 13:
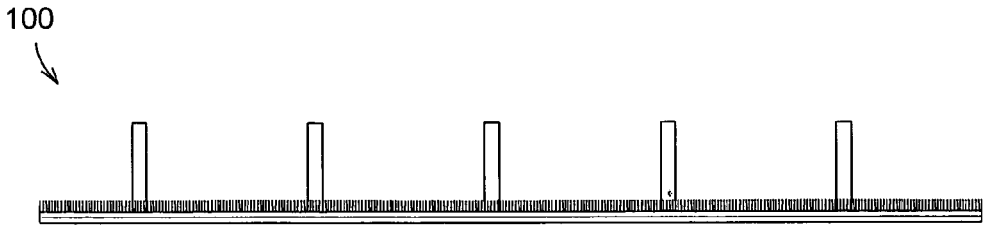
FIG. 13 is a representative first end view of a golfer training aid according to the present invention.
Figure 14:
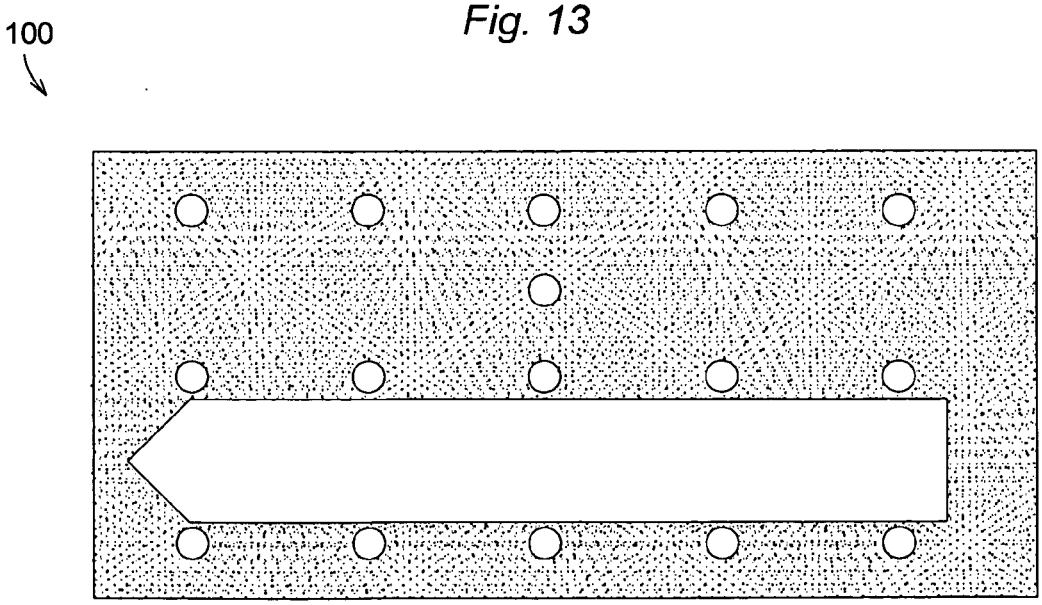
FIG. 14 is a representative bottom view of a golfer training aid according to the present invention.
Figure 15:
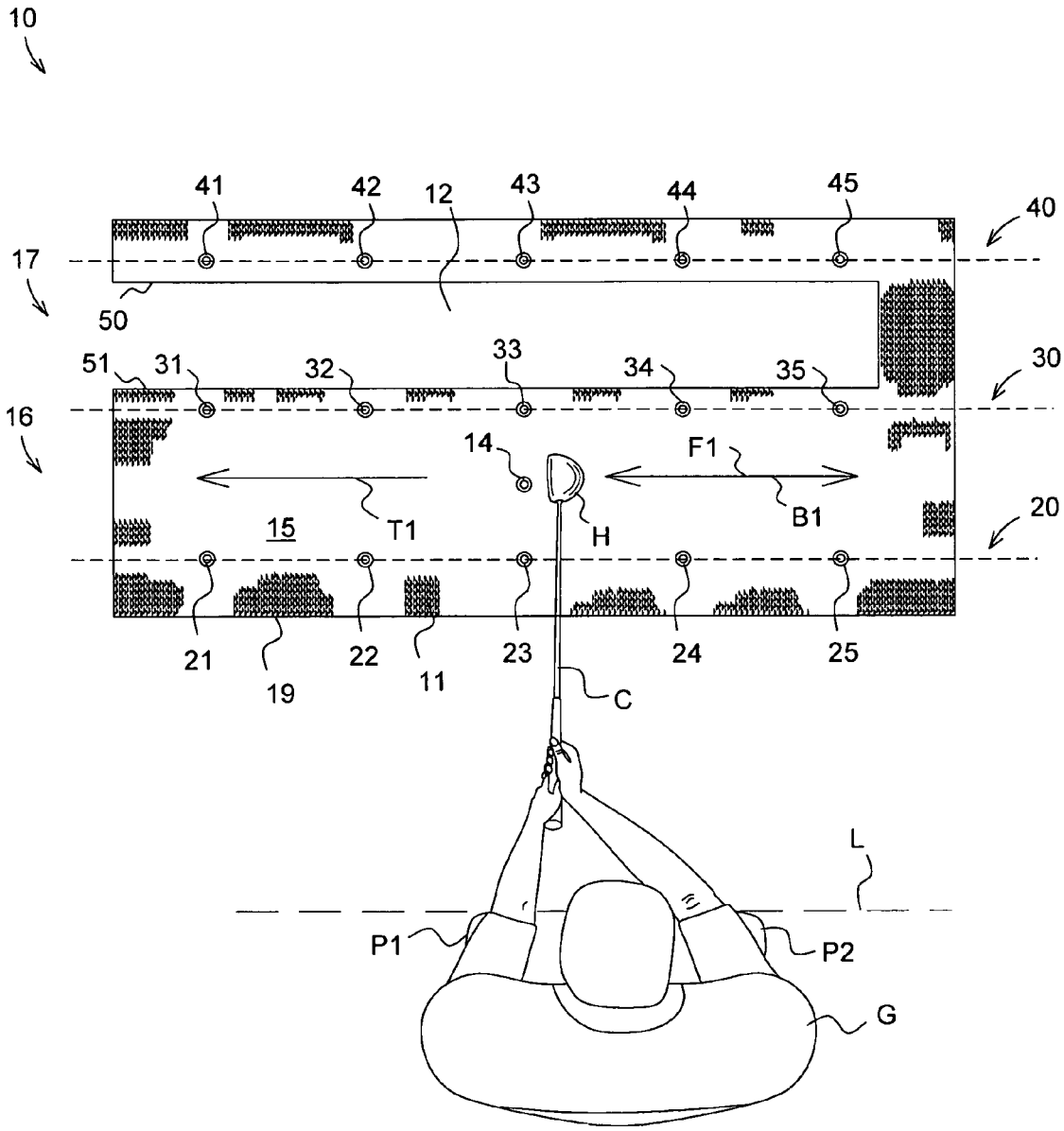
FIG. 15 is a representative top view of a golfer training aid according to the present invention.
Figure 16:
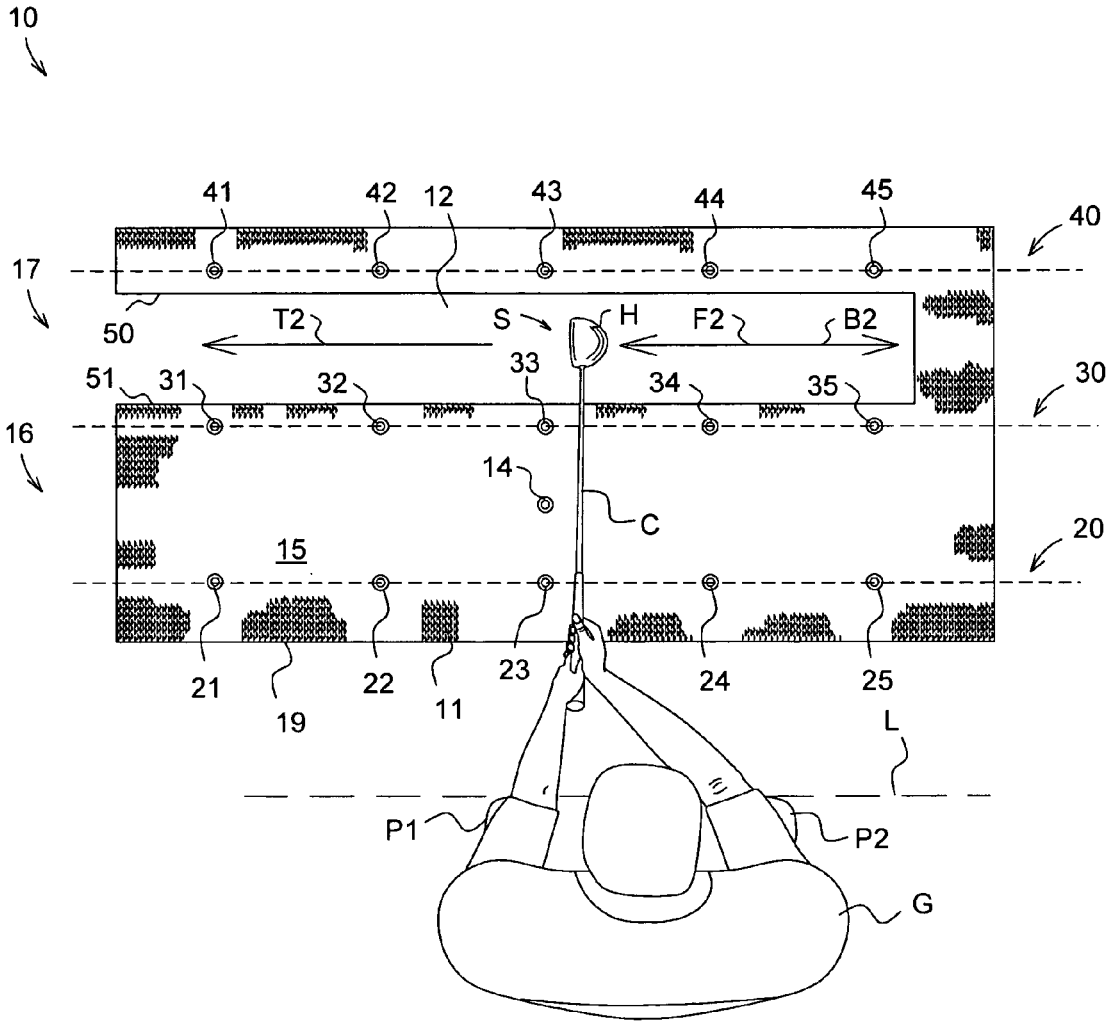
FIG. 16 is a representative top view of a golfer training aid according to the present invention.

Referring to FIGS. 15 and 16, golfer training aid 10 is shown in a top view in use. Golfer training aid 10 includes substantially planar mat 11 which includes upper surface 15. Golfer training aid 10 includes first plurality of uprights 21–25 forming first row of uprights 20, second plurality of uprights 31–35 forming second row of uprights 30 and third plurality of uprights 41–45 forming a third row of uprights 40. First swing channel 16 is defined as an area between opposing first row of uprights 20 and second row of uprights 30. Second swing channel 17 is defined as an area located between opposing edges 50 and 51 of cut-away portion 12 of substantially planar mat 11. Second swing channel 17 is further defined by second row of uprights 30 and third row of uprights 40. As seen in FIGS. 15 and 16, opposing edges 50 and 51 lie substantially parallel to first row of uprights 20, second row of uprights 30, third row of uprights 40 and alignment edge 19 of substantially planar mat 11. Also as seen in FIGS. 15 and 16, first row of uprights 20, second row of uprights 30, third row of uprights 40 each constitute or effectively define first, second and third linearly oriented projections.

In the preferred embodiment, substantially planar mat 11 is formed of a synthetic turf. In the preferred embodiment of the invention, first plurality of uprights 21–25, second plurality of uprights 31–35 and third plurality of uprights 41–45 are all configured as flexible, resilient impact resistant, tubular elements. In the preferred embodiment, first plurality of uprights 21–25, second plurality of uprights 31–35 and third plurality of uprights 41–45 are all configured as tubular rubber tee elements. Similarly, hitting tee 14 is configured as flexible, resilient impact resistant, tubular element. In the preferred embodiment, hitting tee 14 is also configured as a removable tubular rubber tee element, thereby permitting a golfer to hit balls off of hitting tee 14 or in the alternative off of the upper surface 15 of substantially planar mat 11.

In use, referring to FIG. 15, golfer training aid 10 is placed on a surface, preferably a natural surface, for instance turf or lawn. Golfer G positions himself/herself with respect to golfer training aid 10 so that a line L passing across feet P1 and P2 is more or less parallel to alignment edge 19 of substantially planar mat 11. Head H of club C is positioned either in first swing channel 16, as shown in FIG. 15, or second swing channel 17, as shown in FIG. 16. When golfer G sets up so that club head H is positioned in first swing channel 16, as shown in FIG. 15, golfer G may practice the golf swing either with or without hitting a golf ball, (not shown). Alternately, golfer G may practice striking a golf ball, (not shown), either off of hitting tee 14 or from upper surface 15 of substantially planar mat 11 to simulate hitting from a natural or grassy surface. When golfer G sets up so that club head H is positioned in second swing channel 17, as shown in FIG. 16, golfer G may practice the golf swing either with or without hitting a golf ball, (not shown). Alternately, golfer G may practice striking a golf ball, (not shown), either off of a standard golf tee, (not shown), or from the natural or grassy surface.

Whether golfer G sets up so that club head H is positioned in first swing channel 16 or second swing channel 17, the golfer is aided in visualizing and executing a proper golf swing by the visual and physical cues afforded by the golfer training aid 10 of the present invention. As seen in FIG. 15, golfer G positions club head H at a mid point between first row of uprights 20 and second row of uprights 30, in this case just behind hitting tee 14. Golf club C is preferably drawn back on the back swing in such a manner that club head H passes between second row of uprights 20 and third row of uprights 30 without hitting any of the uprights 21–25 or 31–35. Following a preferred course for the back swing, indicated by vector B1, golfer G moves club head H away from the position of hitting tee 14, following a swing path that moves the club head H back from set-up position 14 along back swing vector B1, preferably without contacting either upright 25 or upright 35 as the club head H begins the upward arc of the back swing. In the event that club head H strikes upright 25, golfer G is swinging "inside" on the back swing and golfer G will have a difficult time with having the arms positioned on the fore swing so that one or both elbows do not hit the side of golfer G's body thereby interrupting the fore swing. The return or fore swing follows a path, indicated by vector F1, that lies substantially parallel to first row of uprights 20 and second row of uprights 30. As the club head H passes a location of hitting tee 14, the through swing follows a path, indicated by vector T1, which also remains substantially parallel to first row of uprights 20 and second row of uprights 30.

When golfer G sets up so that club head H is positioned in second swing channel 17, as shown in FIG. 16, golfer G positions club head H at a mid point between second row of uprights 30 and third row of uprights 40. Following a preferred course for the back swing, indicated by vector B2, golfer G moves club head H away from a set-up position indicated generally by the arrow and reference character S, following a swing path that moves the club head H back from set-up position S along back swing vector B2, preferably without contacting either upright 35 or upright 45 as the club head H begins the upward arc of the back swing. The return or fore swing follows a path, indicated by vector F2, that lies substantially parallel to second row of uprights 30 and third row of uprights 40. As club head H passes a location of set-up position S, the through swing follows a path, indicated by vector T2, also remains substantially parallel to second row of uprights 30 and third row of uprights 40.

It is to be understood that the invention is not limited to the embodiment shown and described above. Various other embodiments of the invention may be made and practiced without departing from the scope of the invention, as defined in the following claims.

What is claimed is:

1. A golfer training aid comprising:

a substantially planar mat including an upper surface;

a first swing channel defined by an area of the upper surface of the substantially planar mat located between opposing uprights which project from the upper surface of the substantially planar mat; and a second swing channel defined by an area located between a first edge and a second edge of a cut-away portion of the substantially planar mat.

2. The golfer training aid of claim 1 wherein the substantially planar mat further comprises a synthetic turf.

3. The golfer training aid of claim 1 wherein the opposing uprights further comprises a first plurality of uprights forming a first row of uprights and a second plurality of uprights forming a second row of uprights, the first row of uprights and the second row of uprights defining the first swing channel.

4. The golfer training aid of claim 3 further comprising a third plurality of uprights forming a third row of uprights, the second row of uprights and the third row of uprights further defining the second swing channel.

5. The golfer training aid of claim 1 wherein the opposing uprights further comprises a first plurality of uprights forming a first row of uprights and a second plurality of uprights forming a second row of uprights, the first row of uprights and the second row of uprights defining the first swing channel, the first row of uprights and the second row of uprights oriented substantially parallel to an alignment edge of the substantially planar mat and the second row of uprights oriented substantially parallel to the first row of uprights.

6. The golfer training aid of claim 5 further comprising a third plurality of uprights forming a third row of uprights, the second row of uprights and the third row of uprights further defining the second swing channel, the third row of uprights oriented substantially parallel to the second row of uprights.

7. The golfer training aid of claim 1 wherein the cut-away portion of the substantially planar mat further comprises an aperture formed through the substantially planar mat.

8. A golfer training aid comprising:

a substantially planar mat including an upper surface;

a first plurality of uprights forming a first row of uprights and a second plurality of uprights forming a second row of uprights, the first row of uprights and the second row of uprights defining the first swing channel; and a cut-away portion of the substantially planar mat, the cut-away portion including a first edge and an opposing second edge, the first edge and the opposing second edge of the cut-away portion defining a second swing channel.

9. The golfer training aid of claim 8 wherein the substantially planar mat further comprises a synthetic turf.

10. The golfer training aid of claim 8 further comprising a third plurality of uprights forming a third row of uprights, the second row of uprights and the third row of uprights further defining the second swing channel.

11. The golfer training aid of claim 8 wherein the first row of uprights and the second row of uprights defining the first swing channel are oriented substantially parallel to an alignment edge of the substantially planar mat and the second row of uprights oriented substantially parallel to the first row of uprights.

12. The golfer training aid of claim 8 wherein the cut-away portion of the substantially planar mat is adapted to expose a natural surface upon which the golfer training aid is positioned.

13. The golfer training aid of claim 8 wherein the cut-away portion of the substantially planar mat further comprises an aperture formed through the substantially planar mat.

14. A golfer training aid comprising:

a substantially planar mat including an upper surface;

a first swing channel defined by an area of the upper surface of the substantially planar mat located between a first early oriented projection and an opposing second linearly oriented projection, the first linearly oriented projection oriented substantially parallel to an alignment edge of the substantially planar mat and the linearly oriented projection oriented substantially parallel to the first linearly oriented projection; and a second swing channel defined by a first edge and a second edge of a cut-away portion of the substantially planar mat.

15. The golfer training aid of claim 14 wherein the substantially planar mat further comprises a synthetic turf.

16. The golfer training aid of claim 14 wherein the first linearly oriented projection further comprises a first plurality of uprights forming a first row of uprights and the second linearly oriented projection further comprises a second plurality of uprights forming a second row of uprights, the first row of uprights and the second row of uprights defining the first swing channel, the first row of uprights oriented substantially parallel to an alignment edge of the substantially planar mat and the second row of uprights oriented substantially parallel to the first row of uprights.

17. The golfer training aid of claim 14 further comprising a third linearly oriented projection, the second linearly oriented projection and the third linearly oriented projection further defining the second swing channel.

18. The golfer training aid of claim 14 wherein the second linearly oriented projection further comprises a second plurality of uprights forming a second row of uprights and the third linearly oriented projection further comprises a third plurality of uprights forming a third row of uprights, the second row of uprights and the third row of uprights oriented substantially parallel to an alignment edge of the substantially planar mat.

19. The golfer training aid of claim 14 wherein the cut-away portion of the substantially planar mat further comprises an aperture formed through the substantially planar mat.

* * * * *